United States Patent [19]

Alburger

[11] Patent Number: 4,708,001

[45] Date of Patent: Nov. 24, 1987

[54] FACETED GEM CUT FROM SHALLOW GEMSTONE MATERIAL

[76] Inventor: James R. Alburger, 5007 Hillard Ave., La Canada, Calif. 91011

[21] Appl. No.: 772,434

[22] Filed: Sep. 4, 1985

[51] Int. Cl.[4] ..... A44C 17/00

[52] U.S. Cl. ..... 63/32; D11/90

[58] Field of Search ..... 63/32; 501/86; 125/30 R; D11/89, 90

[56] References Cited

U.S. PATENT DOCUMENTS

| | | | |
|---|---|---|---|
| De. 239,534 | 4/1976 | Michaeli | D11/90 X |
| 712,155 | 10/1902 | Seddon | 63/32 |
| 2,270,270 | 1/1942 | Clare | 63/32 |
| 3,835,665 | 9/1974 | Kitchel | 63/32 |
| 4,604,876 | 8/1986 | Hoffmann | 63/32 |

FOREIGN PATENT DOCUMENTS

| | | | |
|---|---|---|---|
| 130318 | 3/1978 | German Democratic Rep. | 125/30 R |

*Primary Examiner*—Richard J. Johnson

[57] ABSTRACT

A faceted gem having a polished cone-shaped depression cut into the pavillion, said cone being concentric with the vertical axis of the gemstone, and having an included angle at the cone apex of about 90°, and a base diameter equal to about 50% of the girdle diameter. The thus-described polished cone surface reflects light entering the crown, providing a brilliance about equal to that of a correctly-cut gem having full depth of the pavillion. At the same time, the polished internal cone configuration of the pavillion permits a shallow stone to be cut to a maximum girdle diameter, such that the yield in stone size is increased by as much as 50% or more, as compared with the yield obtainable by cutting the pavillion in the conventional manner with correct main angles.

2 Claims, 1 Drawing Figure

FACETED GEM CUT FROM SHALLOW GEMSTONE MATERIAL

Figure 1:
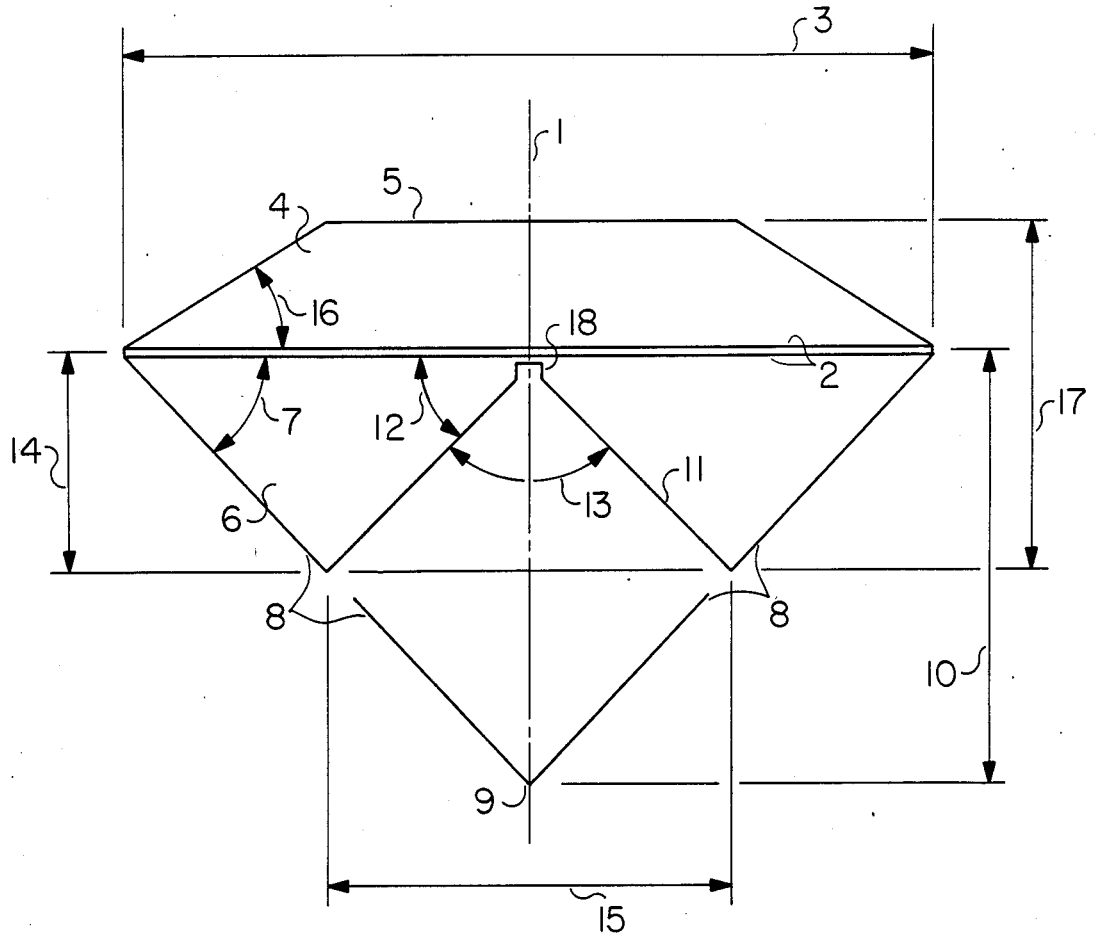

This invention relates to the art of cutting and faceting gemstones. More Particularly, the invention relates to an improvement in the cutting and finishing of the pavillion area of gemstone materials which are too shallow to cut to maximum size without an undesirable loss of brilliance in the finished gem.

The art of cutting and faceting gemstones has become standardized to the extent that there are specific limitations as to the angles of facets with respect to a horizontal plane parallel to the girdle of any given cut design. This is particularly true of the pavillion of a given gemstone, because it is the pavillion and the facets thereof which provide the bulk of reflectivity or brilliance in the finished gem.

A faceted gemstone normally has three principal parts; the crown, or upper part of the gem; the girdle, which is a narrow band around the outer edge of the stone; and the pavillion, which is the bottom part of the stone. The pavillion usually has "main" facets which extend to a point known as the culet. These main facets must have an angle, relative to the girdle plane, which is greater than the "critical angle"of the gemstone material, that is if good brilliance of the finished gemstone is to be obtained.

The size of the finished gemstone is determined by the size (diameter) of the girdle, and other dimensions are usually stated as percentages of the girdle diameter. The crown, for example, usually has a flat polished area parallel to the girdle plane, known as the table, this table having a diameter of about 50% of the girdle diameter. In a conventionally-cut gemstone, having correct main angles, the total depth from table to culet is about 70% to 75% of the girdle diameter, and the pavillion depth, from culet to girdle plane, is about two thirds of the total stone depth, or about half the girdle diameter.

Facet designs are found in an almost infinite variety, where facets are disposed in various arrangements on the crown and pavillion. In a well-cut stone, the girdle is also faceted to match the pavillion and crown facets, but sometimes the girdle is left unfinished as a fine-grind circle. Stone shapes may range from triangular, through square, to multi-sided shapes, and even free-form non-symmetrical shapes. Multi-sided stones having more than four sides may be referred to as "round"stones, and various oval shapes may be considered as being varieties of round stones. In the case of ovals the diameter may be stated as the minimum, maximum, or average distance across the girdle, according to the preference of the cutter.

For the purpose of this specification, a typical round stone, known as a round brilliant, will be used as an illustration, however it will be understood that the invention may be applied to any selected gemstone shape, even though so-called "round"shapes may be preferred.

In modern gem-cutting practice, the proportions of a properly-cut gemstone are fairly well defined. As stated above, the depth of the pavillion is usually about 50% of the girdle diameter, and the height of the crown, above the gridle plane, is usually about 25% of the gridle diameter. These relative dimensions are determined mainly by the index of refraction of the particular gemstone material, and this also determines the minimum angle of the pavillion facets (relative to the gridle plane) which allows light entering the crown to be reflected from the pavillion facets. If the angle of the pavillion "mains"is too small, light will pass through these facets instead of being reflected, resulting in a "window"or a "fish-eye", and the finished stone will lack brilliance.

Obviously, a gemstone which is too shallow in the rough, and which is cut to excessively low main angles, will fail to reflect light properly, and will lack brilliance. In the past, there has been only one solution to the problem presented by a shallow stone, this being to reduce the size of the gridle diameter so as to permit cutting correct angles on crown and pavillion, that is if correct main angles are to be maintained. This may often result in a loss in stone size of as much as 75%, or more.

I have discovered a method and design for modifying the shape of the pavillion of a faceted gemstone, whereby stones having a depth of less than one half the gridle diameter can be cut to yield full brilliance in the finished gem. My new pavillion design has an additional advantage, in that very large stones which are intended to be used as pendants may be cut from shallow material, thus permitting the pendant to hang on the wearer without undue tendency to turn sideways, on effect which would be found where the pavillion has a normal depth.

One object of my invention, therefore, is to provide a modified cut of a gemstone pavillion so as to retain maximum girdle size, while achieving full brilliance in the finished gem.

Another object of the invention is to provide a pavillion cut which allows large gemstones to be cut to shallow depths, thereby providing a desirable shape when the finished gem is to be used as a pendant.

Other and incidental objects of the invention will become apparent to those skilled in the art from a reading of the following specification, and an examination of the accompanying FIGURE.

The essential elements of the invention are illustrated in the diagram of FIG. 1, which is an outline drawing, in vertical cross-section, of the cut configuration of a typical round gemstone, along with the pavillion modification of the invention. For purposes of simplicity, no facets are indicated in the diagram of FIG. 1, although it shall be understood that the outside surfaces of the crown and pavillion are faceted in accordance with a selected facet design.

In FIG. 1, line 1 represents the vertical axis of the gemstone, most stones being cut so that facets are disposed in a symmetrical pattern with respect to this axis. Lines 2 represent the plane of the girdle of the genstone, the thickness of the girdle usually being about 2% of the girdle diameter 3. In conventional gemstone cutting practice, a crown 4 is provided, which has a table 5, a flat area having a diameter which may range from as little as 40% to as much as 60% of the girdle diameter, a preferred range of values being about 50% to 55%, that is for a well-cut gemstone.

The cut of the pavillion 6 is fairly critical, in that the angle 7 must be greater than the so-called critical angle of the gemstone. This critical angle is the angle below which a beam of light parallel to the vertical axis 1 will pass through the pavillion main facets without being reflected. For gemstones having a very high refractive index, this critical angle may be as low as 31°, whereas for stones having a low refractive index, the critical angle may be in the range of 45° or more. The usual Practice in cutting pavillion main facets is to keep their angles about 2° or more above the critical angle, this difference being a matter of preference on the part of the individual cutter.

A conventionally-cut gemstone will have a pavillion 6 which extends from the edge of the girdle 2 down along lines 8 to a pointed tip 9, known as the culet. Lines 8 are shown as discontinuous lines, since the bottom half of the pavillion which appears in a conventionally-cut stone does not appear in the cut of this invention. The depth of a conventionally-cut pavillion is shown as dimension 10 in FIG. 1. It will be noted from an examination of the outline drawing of FIG. 1, that the depth 10 of the pavillion 6, from girdle 2 down to culet 9, in a correctly-cut stone having conventional configuration, is quite considerable, being about half the girdle diameter 3. Many valuable gemstones are found which are too shallow to accomodate the full depth 10 of a conventional pavillion.

To achieve the desired objectives of my invention, a cone-shaped depression 11 is cut into the bottom of the pavillion 6, the sides of this depression having a preferred angle 12, relative to the girdle plane 2, of about 45°. This means that the included angle 13 at the apex of the conical depression 11 should be about 90°, and a 90° cone-shaped grinding point may be used to cut the depression 11. This angle 12 must be greater than the critical angle of the particular gemstone, and may range from as little as 31° up to as much as 60°, depending on the gemstone being cut. Thus, the included angle 13 of the cone 11 may range from about 60° to about 118°, a preferred included preferred included angle being about 90°±5°. Due to variations in tooling. and deviations which occur during cutting and polishing, it is not always possible to achieve a desired angle 13 of the cone to an exact value, hence a small lee-way af about ±5° must be allowed for.

Further examination of the diagram of FIG. 1 will reveal the fact that a gemstone which is cut with a conical depression 11, as described, has a considerably smaller pavillion depth requirement as compared to a pavillion which is cut in the conventional manner. The depth 14 of the modified pavillion of the invention may be less than half as great as the depth 10 of a conventionally-cut pavillion.

When cut to the preferred included angle 13 of about 90°, the conical depression 11 will have a base diameter 15 equal to about 50% of the girdle diameter 3. This closely approximates the preferred diameter of the table 5, which is also about 50% to 55% of the girdle diameter 3. Since the crown main angle 16 is usually cut to somewhat less than 45°, sometimes as low as 15°, it is apparent that the overall height 17 of the finished gemstone of the invention may be considerably less than half the girdle diameter 3.

While the preferred depth of the conical depression 11 of the invention is such that the tip or apex of the cone, point 18, is cut to a level about even with the girdle plane 2, there might be conditions where this depth may vary considerably from the preferred value. For example, in the case of an extremely shallow stone, it might be found desirable to cut the cone-depression of the invention to a depth such that point 18 almost touches the table 5. In cases like this, the diameter 15 of the cone base might be as much as 75% of the girdle diameter 3, and the total depth 17 of the finished gemstone might be as little as 37% the gridle diameter, or even less.

At the other extreme of cone depths, it might be desired to cut a cone-depression which has a depth equal to only about 5% of the girdle diameter. In this case, the diameter 15 of the cone base might be about 10% of the girdle diameter, and the total stone depth 17 will be about 70% of the girdle diameter. Hence, the diameter 15 of the base of the cone-depression of the invention will fall in the range of values from about 10% to 75% of the girdle diameter 3, and the total depth 17 of the finished stone will fall in the range of from about 37% to 70% of the girdle diameter 3.

Procedures for cutting and finishing shallow gemstones in accordance with the invention may vary considerably depending on the techniques which are devised by individual cutters. For purposes of illustration, the following schedule of steps is given, and these procedural steps will result in a finished gemstone, cut in accordance with the invention, which exhibits full brilliance of light reflected from the pavillion facets. It will be understood that when a viewer looks down through the table 5 of a gemstone cut in accordance with the invention the facets on the pavillion will be seen reflected from the polished surface of the conical depression 11.

The first step in performing a gemstone cut in accordance with the invention is to pre-form the stone. A flat area which will eventually become the table 5 is cut by pressing the stone by hand against a rotating flat cutting lap. Next, the stone is mounted on a flat-end dop rod by cementing the flat table area of the stone to the dop. A melted dop wax may be used for this purpose, or for heat-sensitive stones any of various kinds of glues may be used.

The dopped stone is placed in a fixture arranged so the stone can be rotated against a cutting lap or grinding wheel. For round stones, the dop rod is positioned parallel to the cutting surface of the lap or grinding wheel, and the stone is rotated against the cutting surface to grind off excess stone material, resulting in a cylindrical shape having a diameter about equal to the desired finished girdle diameter.

The next step is to set the dop rod at an angle of about 45° to the cutting surface of the lap or grinding wheel, and the stone is then rotated against the cutting surface to produce a cone or truncated cone which will eventually become the pavillion. If the resulting pavillion pre-form is a full cone which extends to a pointed apex, such stones are set aside to be cut in the conventional manner. If the resulting cone is truncated, such stones are trimmed so that the small end of the truncated cone is flat and uniform. These stones are then moved along for cutting a cone-shaped depression in accordance with the invention. For this purpose, the dop rod is positioned perpendicular to the surface of the cutting lap, and the stone is pressed against the lap to form a flat surface parallel to the table. This flat surface is cut so that it has a diameter of between 10% and 75% of the girdle diameter, with a preferred diameter of about 50% of the girdle diameter.

At this point, the cone-shaped depression of the invention may be cut into the stone. This may be accomplished by first drilling a small hole, using a $\frac{3}{4}$ mm or smaller diamond-tipped drill, into the center of the flat surface of the truncated pavillion cone to a preferred depth slightly greater than 25% of the gridle diameter. The depth of this drill hole may be measured by means of a plunger-type dial indicator attached to the drilling machine. The depth of this drill hole should be about 0.020″ greater than the desired finished depth of the conical depression of the invention, so as to provide relief for the tip of the cutting tool used in cutting the cone-shaped depression. The zone of relief is shown in FIG. 1 at point 18.

The cone-shaped depression 11 of the invention is now cut into the stone, using a cone-shaped diamond point having a preferred included angle of the cone of about 90°. If the stage of cutting this cone-depression is performed using a diamond point made with 600 grit or finer diamond, a minimum amount of polishing will be required.

Polishing of the inside surface of the conical depression 11 may be accomplished by using conventional polishing abrasives on a hard felt polishing point.

Having cut and polished the cone-shaped depression 11 of the invention, the pavillion and crown may now be faceted according to conventional procedures.

It will be understood that the cone-shaped depression 11 of the invention may be cut into the pavillion of a given gemstone by means other than the procedure set forth in this specification. For example, laser technology has been developed to a point where gemstone materials, even diamond, may be drilled and cut using a laser beam. Another method, applicable to diamond, is essentially a chemical milling process. A cone-shaped form fabricated from nickel foil is placed in contact with the bottom face of a pre-formed diamond. The diamond and the foil form setup is heated in an atmosphere of hydrogen, whereupon the carbon atoms of the diamond dissolve in the nickel foil and are catalyzed to form methane gas, while the foil form sinks into the diamond to form a cone-shaped depression. The invention is therefore not restricted to any particular method of cutting, shaping, or polishing the cone-shaped depression.

Also, I make no limitation on the depth of the cone-shaped depression of the invention, or the diameter of the cone base relative to the girdle diameter. In the fabrication of any faceted gemstone, the aesthetic appearance of the finished stone is a major consideration, and insofar as this invention is concerned, the maximum brillance and best appearance of the finished gemstone will be obtained if the cone-shaped depression is cut and polished with straight sides and a point or apex 18 of the cone which is as sharp as possible. Also, the diameter of the cone base should be about equal to the table diameter, that is for a pleasing appearance of the finished gemstone. Dimensional ranges and preferred values, given as percentages of girdle diameter, are set forth in Table I. Angles, ranges and preferred values, are set forth in Table II.

TABLE I

| DIMENSIONAL RANGES | | |
|---|---|---|
| Feature | Range - % | Preferred Value - % |
| Total stone depth | 37–75 | 38 |
| Crown height | 10–25 | 20 |
| Table diameter | 40–60 | 50 |
| Girdle thickness | 0–4 | 2 |
| Pavillion depth | 20–40 | 25 |
| Cone depth | 5–50 | 25 |
| Cone base diameter | 10–75 | 50 |
| Initial drill hole | Cone depth plus .020" | |

TABLE II

| ANGLE RANGES | | |
|---|---|---|
| Feature | Range - ° | Preferred Value - ° |
| Crown mains | 15–45 | 30 |
| Pavillion mains | 31–60 | 42 |
| Cone included angle | 60–118 | 90 |

It will be understood that the details of the facet design which may be cut on the outer surfaces of the crown and pavillion may vary greatly depending on individual preference. Also, although I have listed various ranges and preferred values of dimensions and angles, I do not limit my invention to any features other than the relative sizes and angles of the cone-shaped depression as set forth in the appended claims.

Having thus described my invention, I claim:

1. A faceted gem consisting of a gemstone having a faceted crown, a girdle, and a faceted pavillion, said pavillion being cut with a conical depression centered on the vertical axis of said gem, said conical depression having an included angle at the cone apex of from about 60° to 118°, and a base diameter of from about 10% to 75% relative to the girdle diameter, and a cone depth of from about 5% to 50% relative to the girdle diameter, the surface of said conical depression being polished to reflect light.

2. A faceted gem in accordance with claim 1 in which the included angle of said conical depression is essentially 90°±5°.

* * * * *